US005575277A

United States Patent [19]

Lutz et al.

[11] Patent Number: 5,575,277

[45] Date of Patent: Nov. 19, 1996

[54] EQUALIZTION SYSTEM FOR A DIVING MASK

[75] Inventors: James R. Lutz, Round Lake Beach; Keith D. Alsberg, Chicago; James F. Caruso, Evanston; Paul J. Doczy, Chicago; Robert S. Gelick, Evanston; Craig S. Scherer, Wilmette, all of Ill.

[73] Assignee: Johnson Worldwide Associates, Sturtevant, Wis.

[21] Appl. No.: 587,401

[22] Filed: Jan. 17, 1996

[51] Int. Cl.[6] ..... A62B 18/02; A62B 18/08; B63C 11/16

[52] U.S. Cl. ..... 128/201.18; 128/201.27; 128/206.23; 128/201.11

[58] Field of Search ..... 128/201.11, 201.18, 128/201.27, 206.23

[56] References Cited

U.S. PATENT DOCUMENTS

| | | | |
|---|---|---|---|
| D. 266,031 | 9/1982 | Sato . | |
| D. 318,476 | 7/1991 | Sato . | |
| 1,978,994 | 10/1934 | Fortunato | 128/201.18 |
| 3,671,976 | 6/1972 | Johnson et al. . | |
| 4,077,068 | 3/1978 | Anderson . | |
| 4,241,898 | 12/1980 | Segrest . | |
| 4,294,243 | 10/1981 | Ernsting et al. | 128/201.18 |
| 4,352,353 | 10/1982 | Bolton et al. . | |
| 4,667,667 | 5/1987 | Schnoor et al. | 128/201.18 |
| 4,856,120 | 8/1989 | Hart . | |
| 4,926,853 | 5/1990 | Meunier | 128/201.18 |
| 5,275,153 | 1/1994 | Kay . | |
| 5,325,892 | 7/1994 | Japuntich et al. . | |
| 5,329,643 | 7/1994 | Sato . | |
| 5,400,779 | 3/1995 | De Resende . | |
| 5,411,018 | 5/1995 | Rinehart . | |
| 5,485,832 | 1/1996 | Joffity | 128/201.18 |

FOREIGN PATENT DOCUMENTS

| | | | |
|---|---|---|---|
| 108242 | 9/1943 | Sweden . | |
| 2047545 | 12/1980 | United Kingdom | 128/201.18 |

*Primary Examiner*—Kimberly L. Asher
*Attorney, Agent, or Firm*—Foley & Lardner

[57] ABSTRACT

The present invention is directed to a pressure equalization system for use in a dive mask of the type used for scuba diving and skin diving. The dive mask generally includes a frame in which a substantially transparent window or lens is mounted. A flexible skirt is also attached to the frame and includes a nosepiece configured to fit over the nose of the diver. An equalizer system includes a pair of buttons disposed to cooperate with the sidewalls of the nosepiece. The diver can simply press the buttons towards one another to seal his or her nose when equalizing internal and external pressure.

19 Claims, 5 Drawing Sheets

FIG. 1
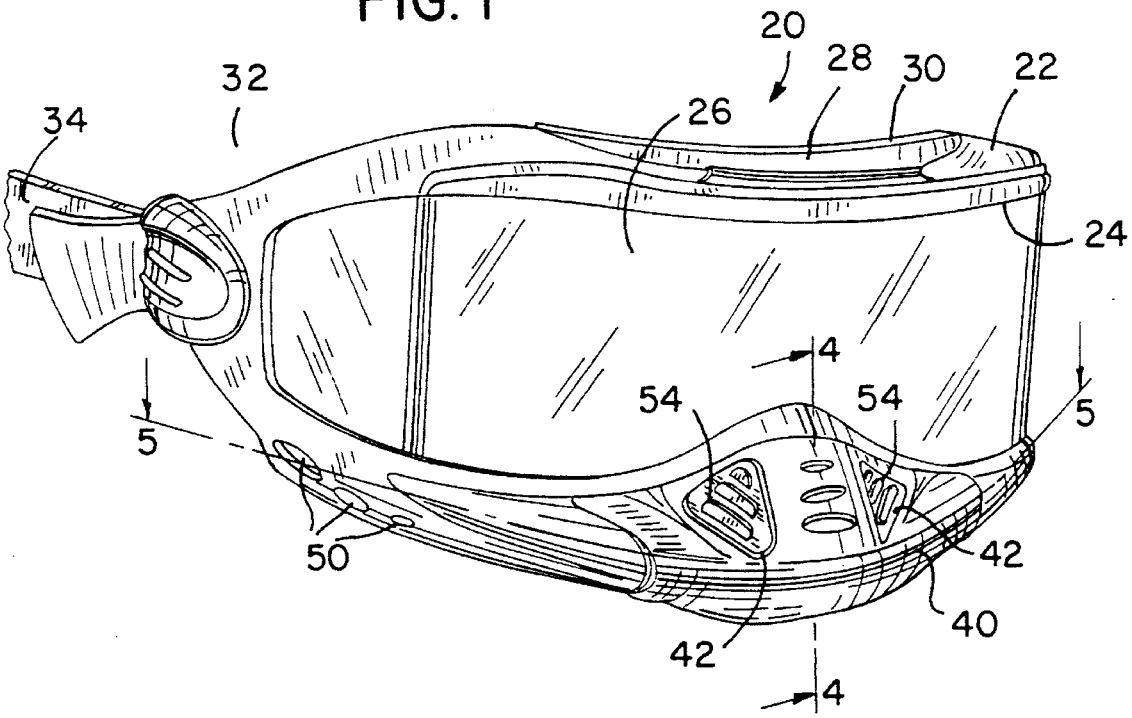
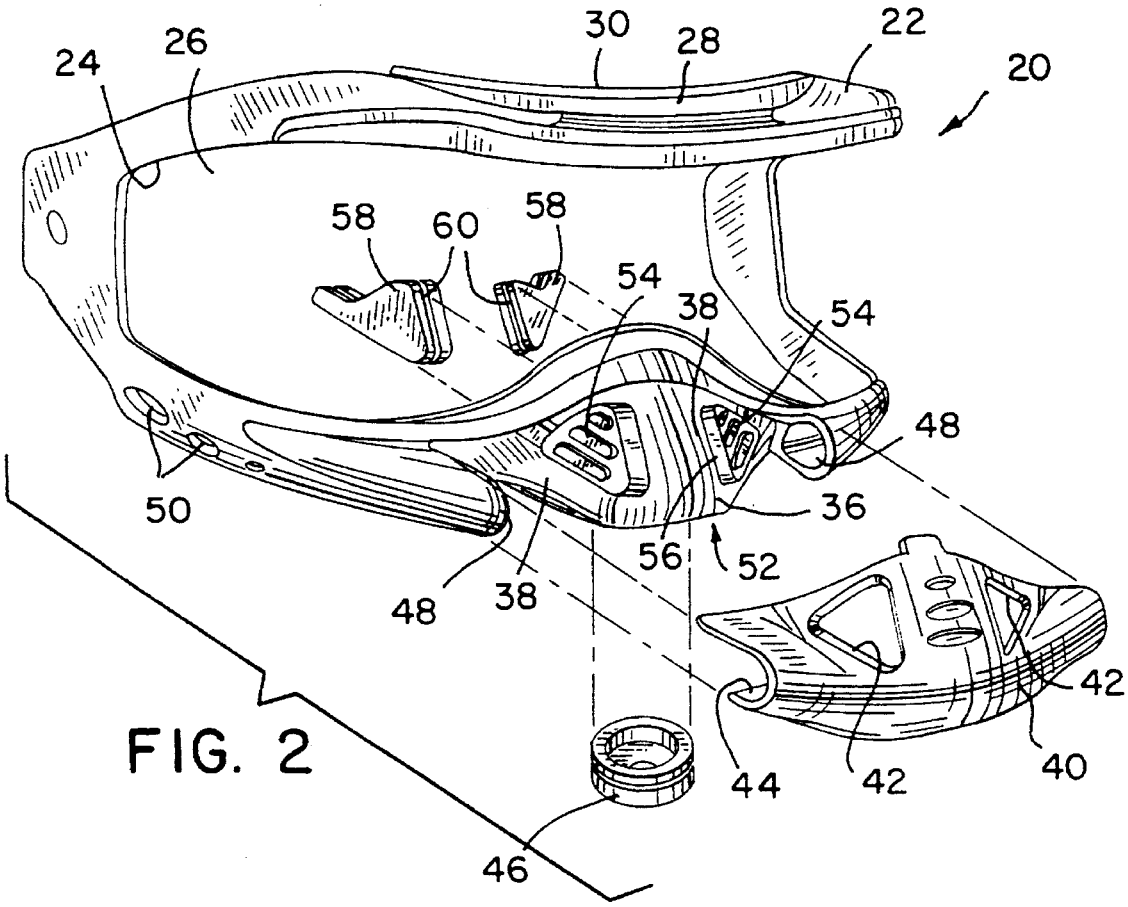
FIG. 2

FIG. 3
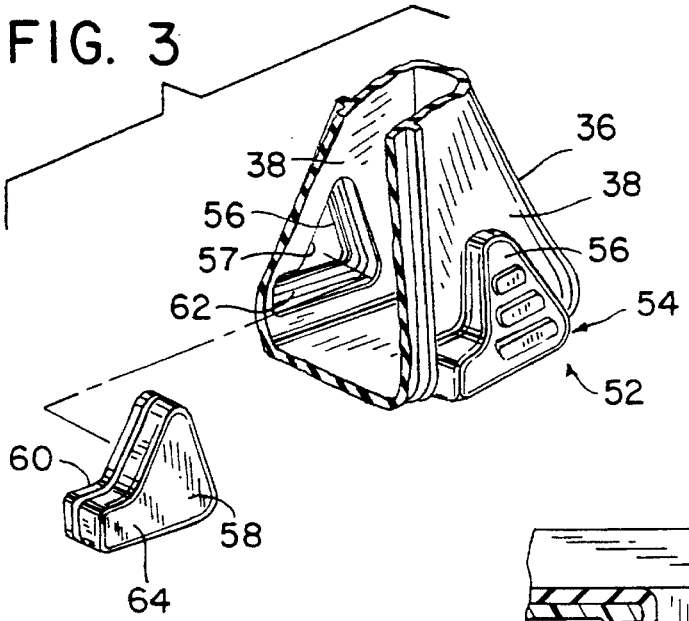
FIG. 6(a)
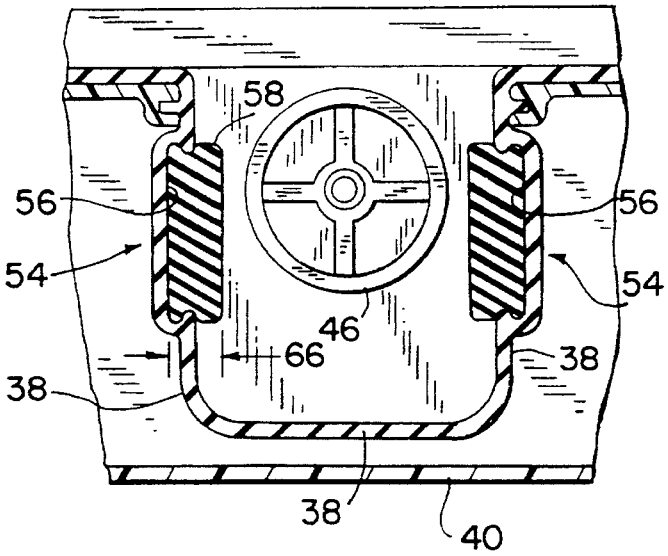
FIG. 6(b)
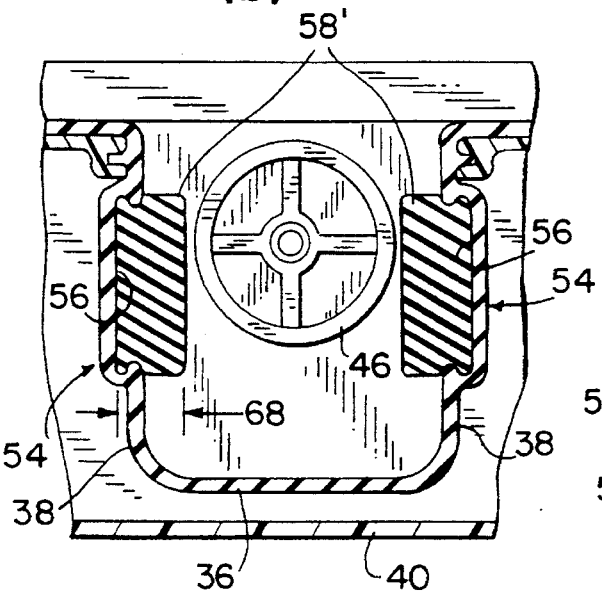
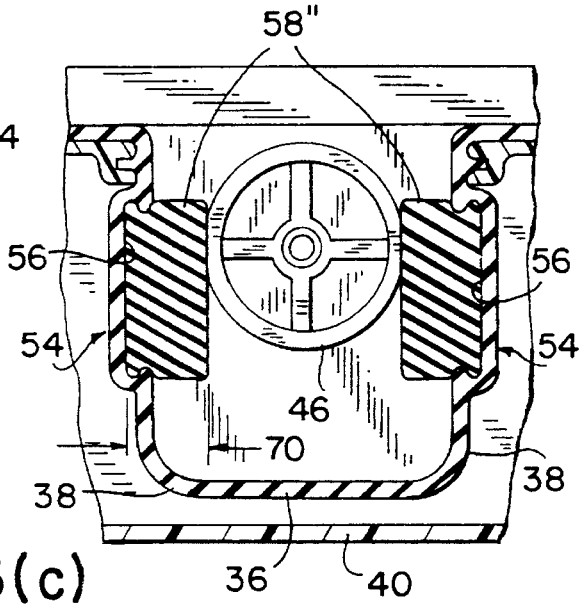
FIG. 6(c)

FIG. 4
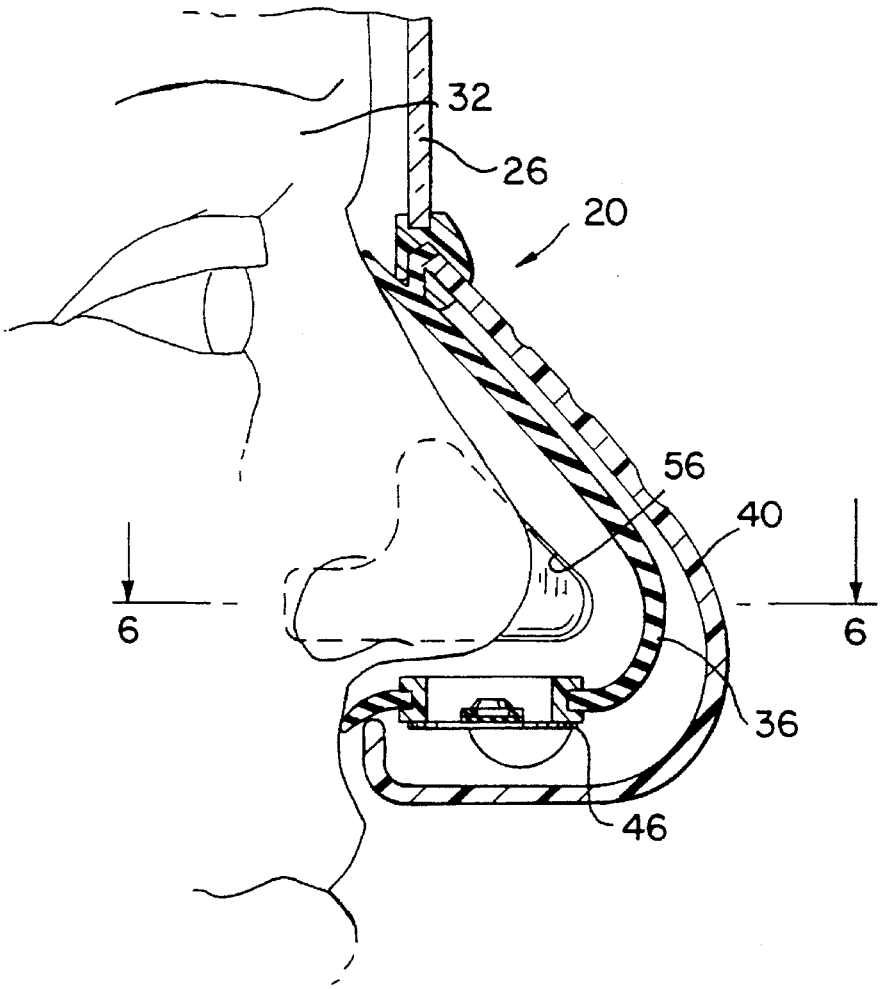
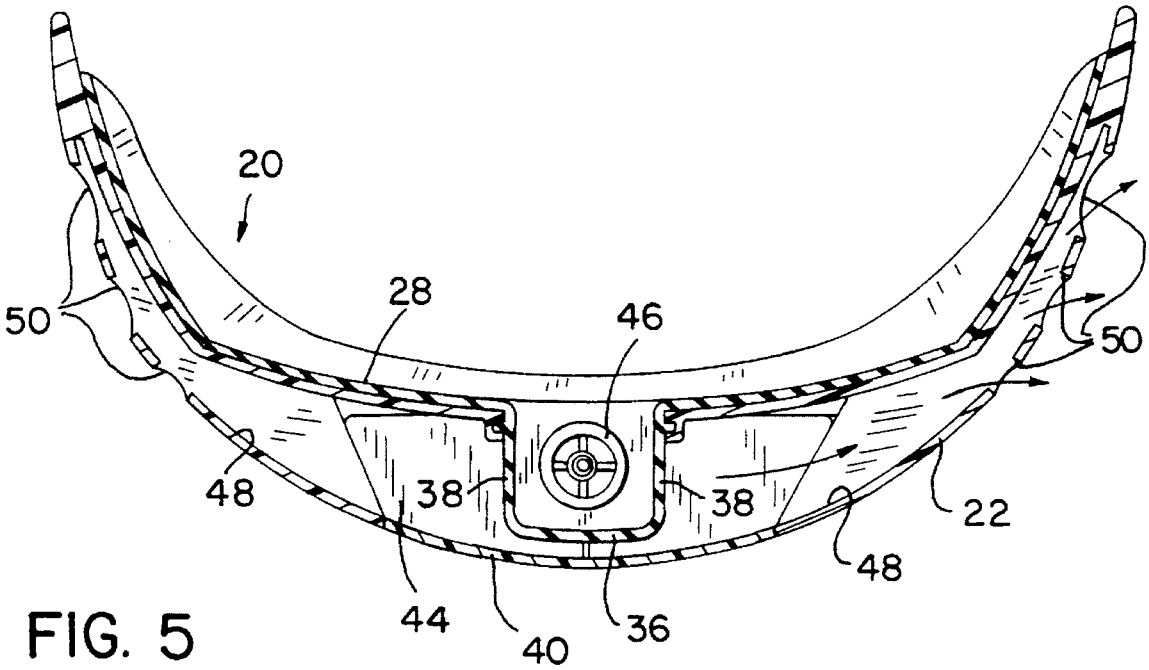
FIG. 5

FIG. 7
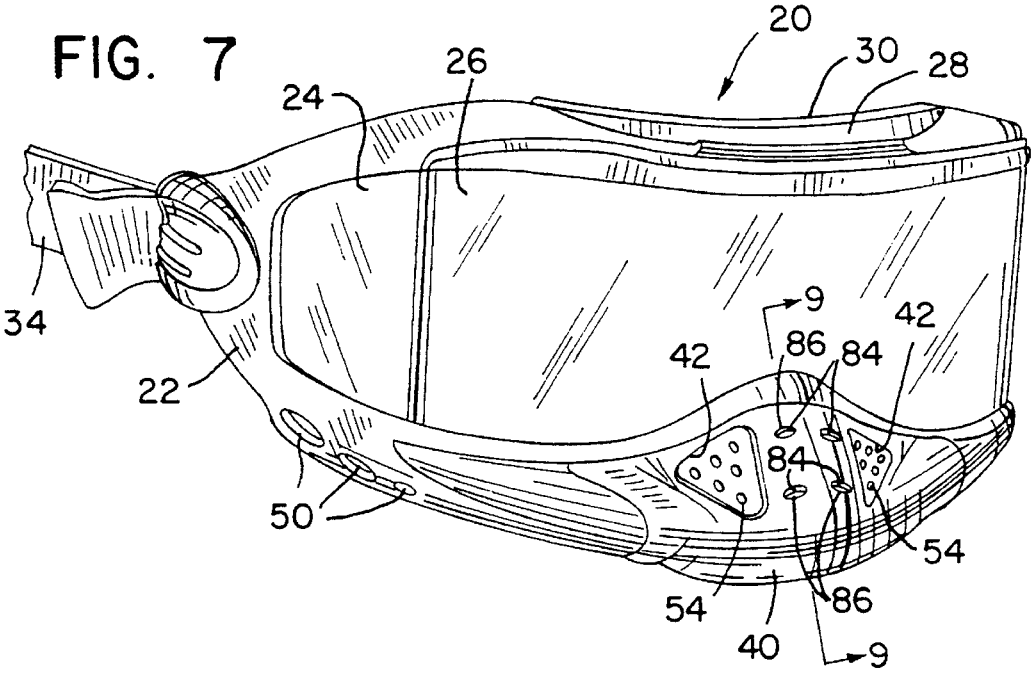
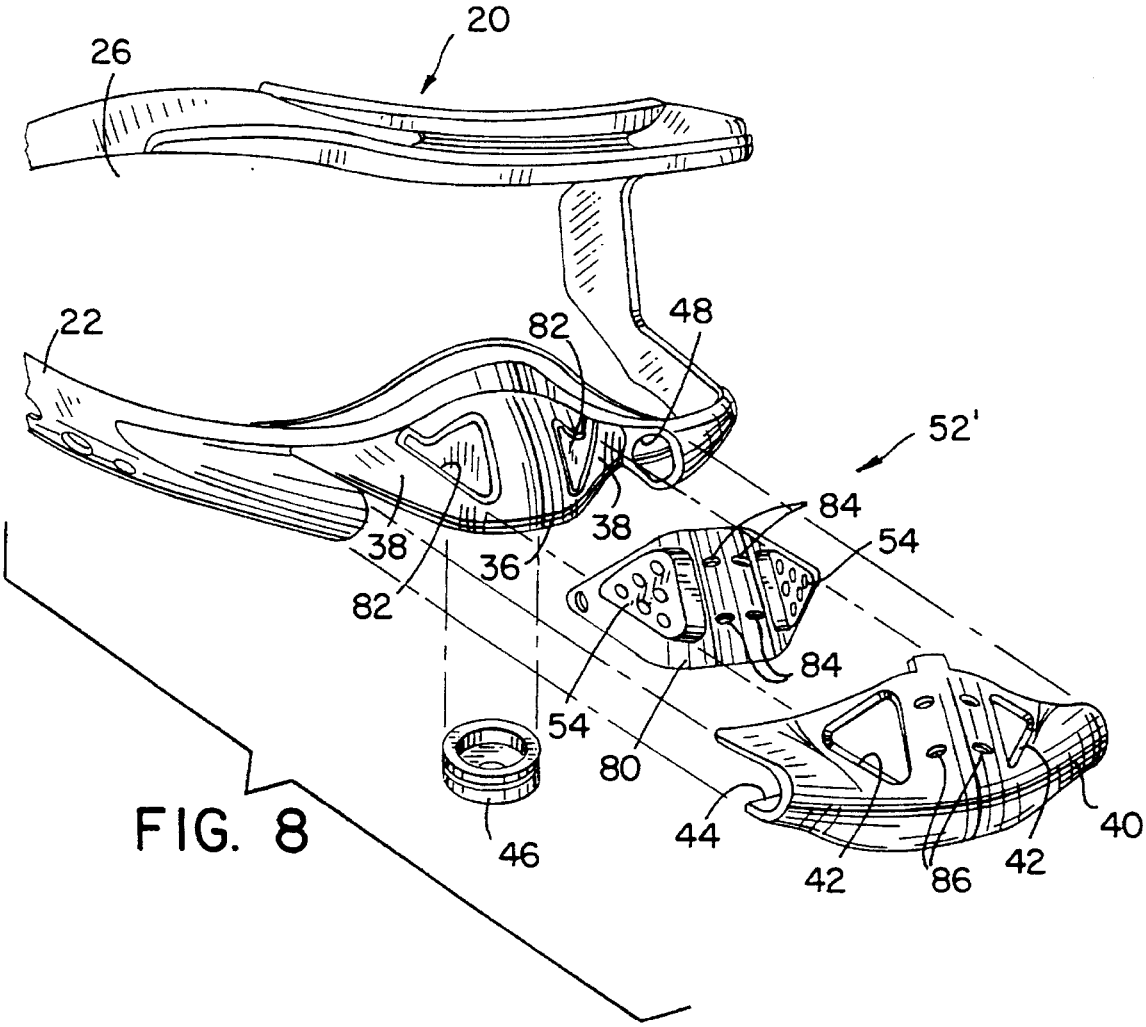
FIG. 8

EQUALIZTION SYSTEM FOR A DIVING MASK

This application is related to copending application Ser. No. 08/550,607.

FIELD OF THE INVENTION

The present invention relates generally to diving masks of the type used in scuba diving or skin diving, and particularly to a pressure equalization system that assists the diver in equalizing the internal and external pressure acting on his or her body at different depths below the surface.

BACKGROUND OF THE INVENTION

Diving masks are generally used by scuba divers and skin divers to facilitate viewing of their surroundings while beneath the surface of the water. A conventional diving mask includes a frame having an opening in which a window or lens is mounted. A flexible skirt is also attached to the frame and extends outwardly therefrom. The flexible skirt is designed to sealingly fit along the face of the diver and generally surround the nose and eyes of the diver. The arrangement of the frame, lens and skirt create an air pocket between the diver's eyes and the lens to facilitate viewing of the underwater environment.

While diving, the pressure exerted against the diver's body changes rapidly as the diver changes depth below the surface. This external pressure can create extreme discomfort for the diver if his or her internal pressure is not generally equalized with the external pressure. Soft tissue areas, such as ears, are particularly susceptible to any difference in external and internal pressure, and can cause pain to the diver if the pressures are not equalized.

Often, it is helpful for the diver to plug his or her nose, while gently creating internal pressure by blowing against the blockage. However, with some of the newer mask designs, it can be difficult for the diver to squeeze his or her nose. Some masks incorporate expanded frames or rigid plastic areas that render it difficult to comfortably reach one's nose. This is particularly true in scuba diving when the diver also has a fairly large regulator grasped in his or her mouth.

It would be advantageous to create an equalization system easily accessible to the fingers of a diver.

SUMMARY OF THE INVENTION

The present invention relates generally to a dive mask designed to cover the eyes and nose of a diver. The dive mask includes a frame and a substantially transparent window or lens mounted in the frame. A flexible skirt is also mounted to the frame and includes a nosepiece configured to fit over the nose of the diver. Specifically, the nosepiece includes a pair of sidewalls disposed generally along the sides of the diver's nose.

A pressure equalization system is included in the dive mask. The equalization system has a pair of buttons disposed to cooperate with the pair of sidewalls. The diver can move the pair of buttons towards his nose to prevent air flow therethrough.

According to one aspect of the invention, a rigid plate is also mounted to the frame and extends generally along the nosepiece. The rigid plate includes a pair of button openings that permit access to the pair of buttons. Thus, even though the flexible nosepiece is protected by a rigid plate, the diver still maintains access to the buttons, permitting blockage of the nose and equalization of the external and internal pressures acting on the diver.

BRIEF DESCRIPTION OF THE DRAWINGS

The invention will hereafter be described with reference to the accompanying drawings, wherein like reference numerals denote like elements, and:

FIG. 1 is a perspective view of a dive mask having a pressure equalization system according to a preferred embodiment of the present invention;

FIG. 2 is an exploded view of the dive mask of FIG. 1;

FIG. 3 is a partial cutaway view of the nosepiece of FIG. 2;

FIG. 4 is a cross-sectional view taken generally along line 4—4 of FIG. 1;

FIG. 5 is a cross-sectional view taken generally along line 5—5 of FIG. 1;

FIG. 6*a* is a cross-sectional view taken generally along line 6—6 of FIG. 4;

FIG. 6*b* is a cross-sectional view similar to 6*a* but showing a pair of inserts having a different thickness;

FIG. 6*c* is a cross-sectional view similar to that shown in FIG. 6*a* but showing a pair of inserts having a second different thickness;

FIG. 7 is a perspective view of a dive mask according to an alternate embodiment of the present invention;

FIG. 8 is an exploded view of the dive mask of FIG. 7;

DETAILED DESCRIPTION OF THE PREFERRED EMBODIMENT

Figure 9:
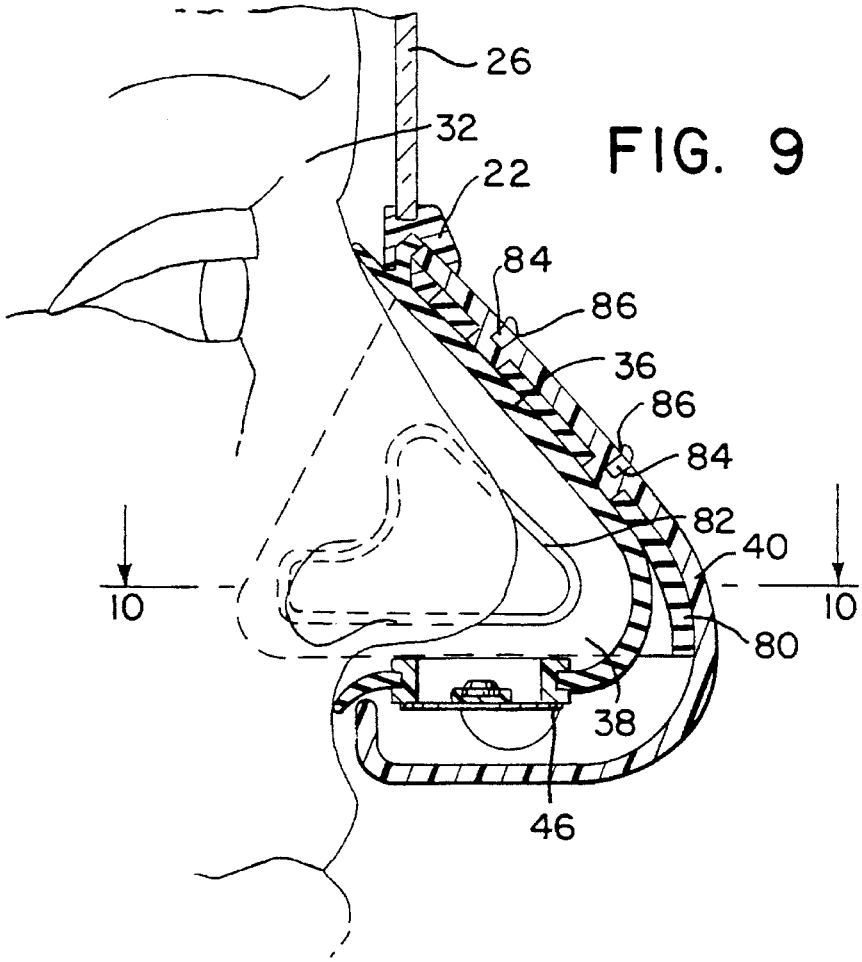
FIG. 9 is a cross-sectional view taken generally along line 9—9 of FIG. 7.

Referring generally to FIGS. 1 and 2, a dive mask 20, according to a preferred embodiment of the present invention, is illustrated. Dive mask 20 generally includes a frame 22 having an opening 24 in which is mounted a substantially transparent window 26, sometimes known as a lens. A flexible skirt 28 is attached to frame 22 and extends outwardly therefrom to terminate in a peripheral edge 30. Flexible skirt 28 is preferably made from a relatively soft, flexible material, such as silicone, and peripheral edge 30 is configured to lie along the face of a diver 32 to generally cover or surround the eyes and nose of the diver 32. Additionally, a strap 34 is attached to frame 22 and is designed to extend around the back of the diver's head to secure dive mask 20 against his or her face.

In the illustrated embodiment, flexible skirt 28 includes a flexible nosepiece 36 configured to fit over the nose of the diver and including a pair of sidewalls 38 that lie generally along the sides of the diver's nose. In this particular embodiment, nosepiece 36 is covered by a generally rigid plate 40 that can be attached to frame 22. (See FIG. 4) The attachment to frame 22 can be accomplished according to a variety of methods known to those of ordinary skill in the art, such as interlocking plastic tabs or adhesive.

Rigid plate 40 is preferably made from a plastic dive mask material that is stiffer than the material used for nosepiece 36. Additionally, rigid plate 40 includes an open area, preferably in the form of a pair of openings 42 to permit access to nosepiece 36. Furthermore, rigid plate 40 includes an air channel 44 disposed along its bottom portion to cooperate with a purge valve 46. Purge valve 46 is preferably disposed through the bottom of nosepiece 36, as best illustrated in FIGS. 2, 4 and 5.

Air channel 44 is designed to receive air exhaled by diver 32 through purge valve 46 and to conduct that air outwardly to a pair of air tunnels 48 formed in frame 22. Air tunnels 48 further direct the exhaled air outwardly to at least one exit opening and preferably a plurality of exit openings 50 located generally along the sides of dive mask 20. Thus, when diver 32 exhales, the exhaled air is moved laterally to exit openings 50 to prevent the rising bubbles from interfering with the diver's vision.

As best illustrated in FIGS. 3 and **6*a*–6*c*, a pressure equalization system 52 cooperates with or is incorporated into nosepiece 36 to help diver 32 equalize the external and internal pressure acting on his or her body. Pressure equalization system 52 includes a pair of press buttons 54 that are exposed to the diver through the open area in rigid plate 40, e.g., openings 42. In the preferred embodiment, press buttons 54 are appropriately sized to extend through openings 42, thereby permitting diver 32 to squeeze buttons 54** towards one another and restrict or block air flow through the nose.

In the embodiment illustrated in FIGS. 3 and **6*a*–6*c*, press buttons 54 include a pair of pockets 56 formed in sidewalls 38 of nosepiece 36. Pockets 56 preferably each include an opening 57 disposed on the interior of the sidewall as illustrated in FIG. 3. A pair of inserts 58 are configured for insertion into pockets 56. A single insert 58 is inserted into each pocket 56 and can be held there in a variety of ways. For example, each insert 58 can include a perimeter ridge 60 designed to matingly engage a corresponding groove 62 disposed on the interior of each pocket 56. When each insert 58 is inserted into its corresponding pocket 56, an interior surface 64 of that insert 58** is disposed for contact with the diver's nose.

One benefit of using removable inserts 58 in pressure equalization system 52 is the ability to customize the pressure equalization system to the size of the diver's nose. The diver simply selects inserts having an appropriate thickness to restrict or block air flow through his or her nose with minimal inward movement of press buttons 54.

For example, FIG. **6*a* illustrates a pair of inserts 58 having a first desired thickness 66. If diver 32 has a narrower nose, a second set of inserts 58' can be inserted or interchanged with inserts 58. Inserts 58' have a greater thickness 68. If the diver's nose is narrower yet, inserts 58" having a still greater thickness 70 can be inserted into pockets 56. Thus, inserts having a variety of thicknesses can selectively be interchanged to customize pressure equalization system 52 to the size of the diver's nose. In fact, an insert of one thickness could be inserted into one pocket and an insert of a second thickness could be inserted into the opposite pocket 56**, if necessary for the comfort of the diver.

An alternate embodiment of the pressure equalization system 52, labelled as pressure equalization system 52', is illustrated in FIGS. 7–11. For clarity, the reference numerals will be maintained consistent, where possible, with the reference numerals used in FIGS. 1–6.

In this alternate embodiment, press buttons 54 are mounted to a flexible sheet 80, disposed between nosepiece 36 and rigid plate 40. Press buttons 54 are located specifically on flexible sheet 80 to permit them to be pressed against sidewalls 38 of nosepiece 36 proximate a pair of pressure regions 82. Pressure regions 82 may have a perimeter of reduced thickness 83 to facilitate their inward movement towards the nose of the diver.

Press buttons 54 are preferably thicker and somewhat stiffer than the material used to form nosepiece 36 e.g., a stiffer or harder silicone. As described above with reference to FIGS. 1–6, press buttons 54 are preferable sized to fit through an open area, such as a pair of openings 42, in rigid plate 40.

Flexible sheet 80 is disposed between nosepiece 36 and rigid plate 40. It can be held in place in various ways, including adhesives, or a plurality of pins 84, as illustrated in FIG. 8. Pins 84 are configured for an interference fit with a plurality of corresponding openings 86 through rigid plate 40.

Figure 10:
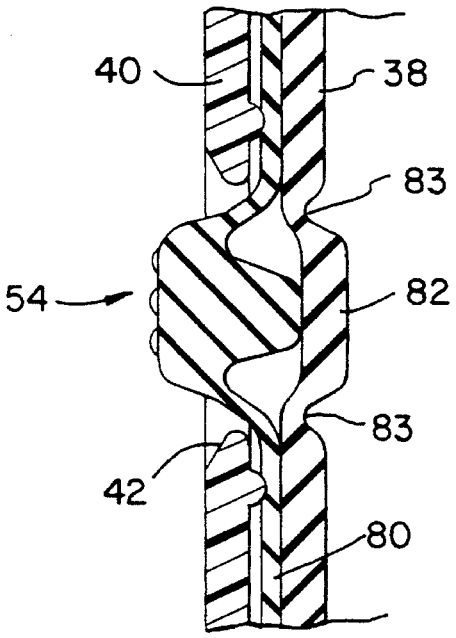
FIG. 10 is a partial cross-sectional view taken generally along line 10—10 of FIG. 9.
Figure 11:
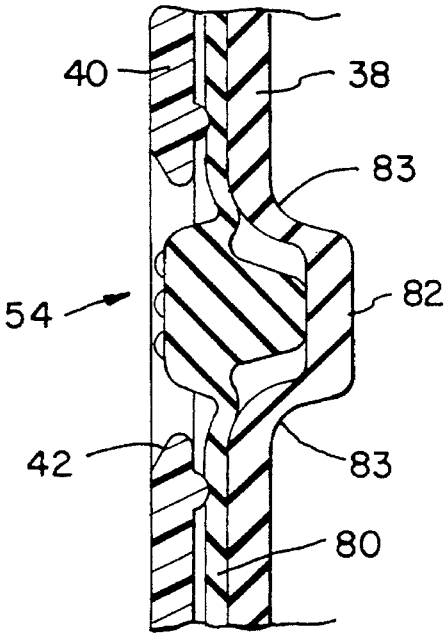
FIG. 11 is a cross-sectional view similar to that shown in FIG. 10, but having the push button depressed.

As illustrated in FIG. 10, each press button 54 normally lies proximate a corresponding pressure region 82, but does not block air flow through the diver's nose. However, when the diver presses buttons 54 towards one another, pressure regions 82 are extended inwardly to contact and squeeze the diver's nose. This restricts or blocks air flow through his or her nose to facilitate equalization of internal and external pressures acting on the diver's body.

It will be understood that the foregoing description is of preferred exemplary embodiments of this invention and that the invention is not limited to the specific form shown. For example, a variety of materials may be used to make the nosepiece, press buttons or rigid plate. The pressure equalization system can be adapted for use with diving masks of a variety of styles and configurations, including single lens or dual lens type masks. Additionally, even though the system is typically used with a purge valve, it can also be incorporated into masks that do not include purge valves. These and other modifications may be made in the design and arrangement of the elements without departing from the scope of the invention as expressed in the appended claims.

What is claimed is:

1. A dive mask designed to cover the eyes and nose of a diver, comprising:

a frame;

a window mounted in the frame;

a flexible skirt mounted to the frame, the flexible skirt including a nosepiece having a pair of sidewalls having interior and exterior sides, the interior sides of said nosepiece sidewalls configured to fit along the nose of a diver; and an equalizer system having a pair of buttons disposed to cooperate with the pair of sidewalls on the exterior sides of the sidewalls, said pair of buttons being manually movable between a depressed position where said pair of buttons move said nosepiece sidewalls towards a diver's nose to pinch the nose closed, and a non-depressed position.

2. The dive mask as recited in claim 1, further comprising a rigid plate mounted along the nosepiece, the rigid plate including an opening that permits access to the pair of buttons.

3. The dive mask as recited in claim 2, further comprising a purge valve mounted in the nosepiece.

4. The dive mask as recited in claim 3, wherein the rigid plate includes a first air channel disposed to receive air exhaled through the purge valve and the frame includes a second air channel disposed to receive air form the first channel and having at least one exit opening.

5. The dive mask as recited in claim 2, wherein the pair of buttons is mounted to a flexible sheet.

6. The dive mask as recited in claim 5 wherein the flexible sheet is disposed generally between the rigid plate and the nosepiece.

7. The dive mask as recited in claim 6, wherein the flexible sheet is attached to the rigid plate.

8. The dive mask of claim 1, wherein each button of the pair of buttons includes a pocket formed in the nosepiece and a removable insert configured to fit within the pocket.

9. The dive mask as recited in claim 8, wherein the removable insert includes a perimeter ridge and the pocket includes a groove to receive and hold the perimeter ridge.

10. The dive mask as recited in claim 9, further comprising a rigid plated mounted along the nosepiece, the rigid plate including a pair of button openings that permit access to the pair of buttons.

11. The dive mask as recited in claim 10, further comprising a purge valve mounted in the nosepiece, wherein the rigid plate includes an air channel disposed to receive and direct air exhaled through the purge valve.

12. The dive mask as recited in claim 10, wherein the pocket includes an opening for receiving the removable insert, the opening being disposed in an interior of the nosepiece.

13. A dive mask equalization system for use with a dive mask of the type worn by a diver to cover the nose and eyes of the diver and having a frame, a window and a flexible skirt attached to the frame, the dive mask equalization system comprising:

a flexible nosepiece formed in the flexible skirt to fit generally over the nose of the diver, the flexible nosepiece including a pair of sidewalls, each sidewall having an interior side and an exterior side, and further including a pocket configured to receive an insert on said exterior sides of said sidewalls, a pair of inserts, each insert having a desired thickness and being selectively insertable into a pocket, said inserts being manually movable between a depressed position where said pair of insets move said nosepiece sidewalls towards a diver's nose to pinch the nose closed, and a non-depressed position.

14. The dive mask equalization system as recited in claim 13, further comprising a second pair of inserts interchangeable with the first pair of inserts, at least one insert of the second pair of inserts having a thickness different from the desired thicknesses of the first pair of inserts.

15. The dive mask equalization system as recited in claim 13, further comprising a rigid plate disposed generally over the flexible nosepiece, the rigid plate having an open area disposed to permit the diver to squeeze the pair of inserts towards the nose of the diver.

16. A dive mask equalization system for use with a dive mask of the type worn by a diver to cover the nose and eyes of the diver and having a frame, a window mounted in the frame and a flexible skirt attached to the frame, the dive mask equalization system comprising:

a flexible nosepiece formed in the flexible skirt to fit generally over the nose of the diver, the flexible nosepiece including a pair of sidewalls;

a rigid plate attached to the frame and disposed generally over the nosepiece, the rigid plate having at least one open area;

a pair of press buttons oriented proximate the at least one open area said pair of press buttons being manually movable between a depressed position where said pair of press buttons move said nosepiece sidewalls towards a diver's nose to pinch the nose closed, and a non-depressed position.

17. The dive mask equalization system as recited in claim 16, wherein the press buttons are connected by a flexible sheet disposed between the flexible nosepiece and the rigid plate.

18. The dive mask equalization system as recited in claim 17, wherein the flexible sheet is attached to the rigid plate.

19. The dive mask equalization system as recited in claim 18, wherein the at least one open area includes a pair of openings, each opening being sized to receive one of the press buttons therethrough.

* * * * *